US006253645B1

(12) United States Patent
Lin

(10) Patent No.: US 6,253,645 B1
(45) Date of Patent: Jul. 3, 2001

(54) RATCHET SCREW DRIVER

(76) Inventor: Ching Chou Lin, No. 150, Sec. 3, Chung San Road, Wu Zh Hsiang, Taichung Hsien (TW)

( * ) Notice: Subject to any disclaimer, the term of this patent is extended or adjusted under 35 U.S.C. 154(b) by 0 days.

(21) Appl. No.: 09/467,496

(22) Filed: Dec. 20, 1999

(51) Int. Cl.[7] ..... B25B 13/00

(52) U.S. Cl. ..... 81/58.3; 81/58.4; 81/63.1; 81/177.8

(58) Field of Search ..... 81/58.3, 58.4, 81/63.1, 177.8

(56) References Cited

U.S. PATENT DOCUMENTS 5,211,086 * 5/1993 Shu .
5,570,616 * 11/1996 Thompson et al. .
5,782,146 7/1998 Lin ..... 81/58
5,875,692 3/1999 Lin ..... 81/58
5,967,003 10/1999 Lin ..... 81/58.3
5,974,915 * 11/1999 Chou .
6,047,617 * 4/2000 Chen .

* cited by examiner

*Primary Examiner*—Timothy V. Eley
*Assistant Examiner*—Willie Berry, Jr.
(74) *Attorney, Agent, or Firm*—Charles E. Baxley

(57) ABSTRACT

A ratchet screw driver includes a shaft rotatably received in a handle, two follower ratchet gears slidably engaged on and rotated with the shaft, two driving ratchet gears rotatably and slidably engaged on the shaft, and a spring biasing the driving ratchet gears to engage with the follower ratchet gears. A barrel and a ferrule are secured together and rotatably secured to the handle and each has an actuating surface for selectively disengaging the driving ratchet gears from the follower ratchet gears to control the driving direction of the shaft.

6 Claims, 6 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

The applicant has developed three typical screw drivers which are disclosed in U.S. Pat. No. 5,782,146 to Lin, U.S. Pat. No. 5,875,692 to Lin, and U.S. Pat. No. 5,967,003 to Lin. The ratchet mechanisms of the typical screw drivers include one or more pairs of ratchet gears rotatably and/or slidably engaged on a driving stem and received in the handle. The typical screw drivers have no devices that may be used to operate or move the ratchet gears relative to each other.

The present invention has arisen to mitigate and/or obviate the afore-described disadvantages of the conventional screw drivers.

SUMMARY OF THE INVENTION

The primary objective of the present invention is to provide a ratchet screw driver which includes one or more pairs of ratchet gears rotatably and slidably received in a housing and may be operated by an outer control ferrule.

In accordance with one aspect of the invention, there is provided a ratchet screw driver comprising a handle including a bore formed therein and including a front portion and including a rear portion, a shaft rotatably received in the handle, a first and a second ratchet gears slidably engaged on the shaft and rotated in concert with the shaft, a third and a fourth ratchet gears rotatably and slidably engaged on the shaft and slidably engaged in the housing and rotated in concert with the housing, means for biasing the third and the fourth ratchet gears to engage with the first and the second ratchet gears respectively, and means for selectively disengaging the third and the fourth ratchet gears from the first and the second ratchet gears respectively to control a driving direction of the shaft.

A housing is secured in the handle and includes at least one channel formed therein, a barrel rotatably engaged on the shaft and rotatably received in the housing. The third and the fourth ratchet gears each includes a projection extended through the barrel and slidably engaged in the channel of the housing for allowing the third and the fourth ratchet gears to be slided in and rotated in concert with the housing.

The selectively disengaging means includes a ferrule secured to the barrel and having at least one extension extended therefrom and engaged with the projection of the third ratchet gear for disengaging the third ratchet gear from the first ratchet gear, and the selectively disengaging means includes at least one actuating surface provided in the barrel for engaging with the projection of the fourth ratchet gear and for disengaging the fourth ratchet gear from the second ratchet gear.

A securing device is further provided for securing the barrel to the housing at a selected angular position. The housing includes three recesses formed therein, the barrel includes a slit formed therein, the securing means includes a spring having a first end secured to the barrel and having a second end slidably engaged in the slit of the barrel, the second end of the spring is selectively engaged in either of the recesses of the housing for securing the barrel to the housing at the selected angular position.

A limiting means is further provided and includes two rings secured on the shaft and disposed between the first and the third ratchet gears and between the second and the fourth ratchet gears for limiting the relative movement between the first and the third ratchet gears and between the second and the fourth ratchet gears.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
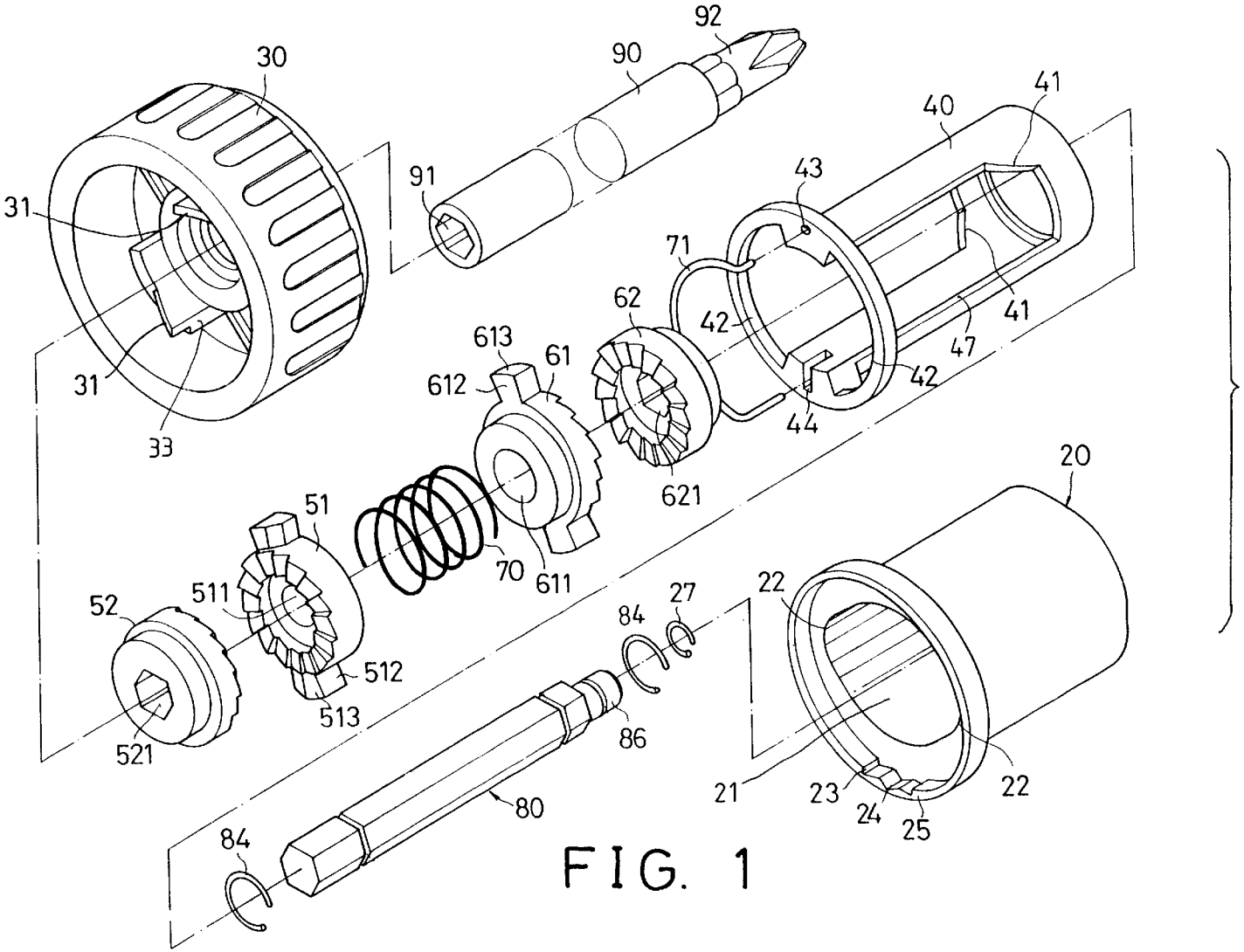
FIG. 1 is an exploded view, seeing from the rear portion, of a ratchet screw driver in accordance with the present invention.
Figure 2:
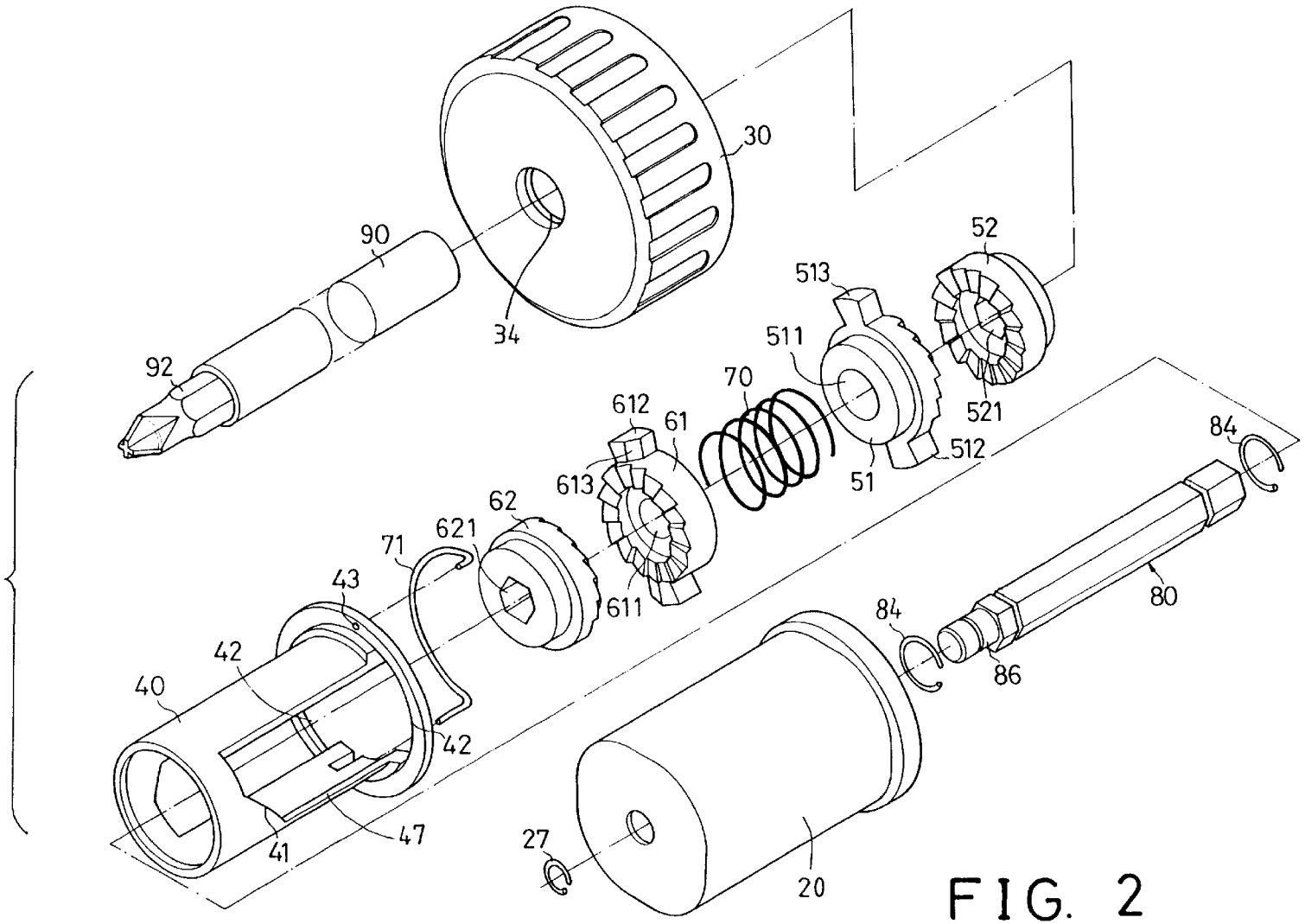
FIG. 2 is an exploded view, seeing from the front portion, of the ratchet screw driver.
Figure 3:
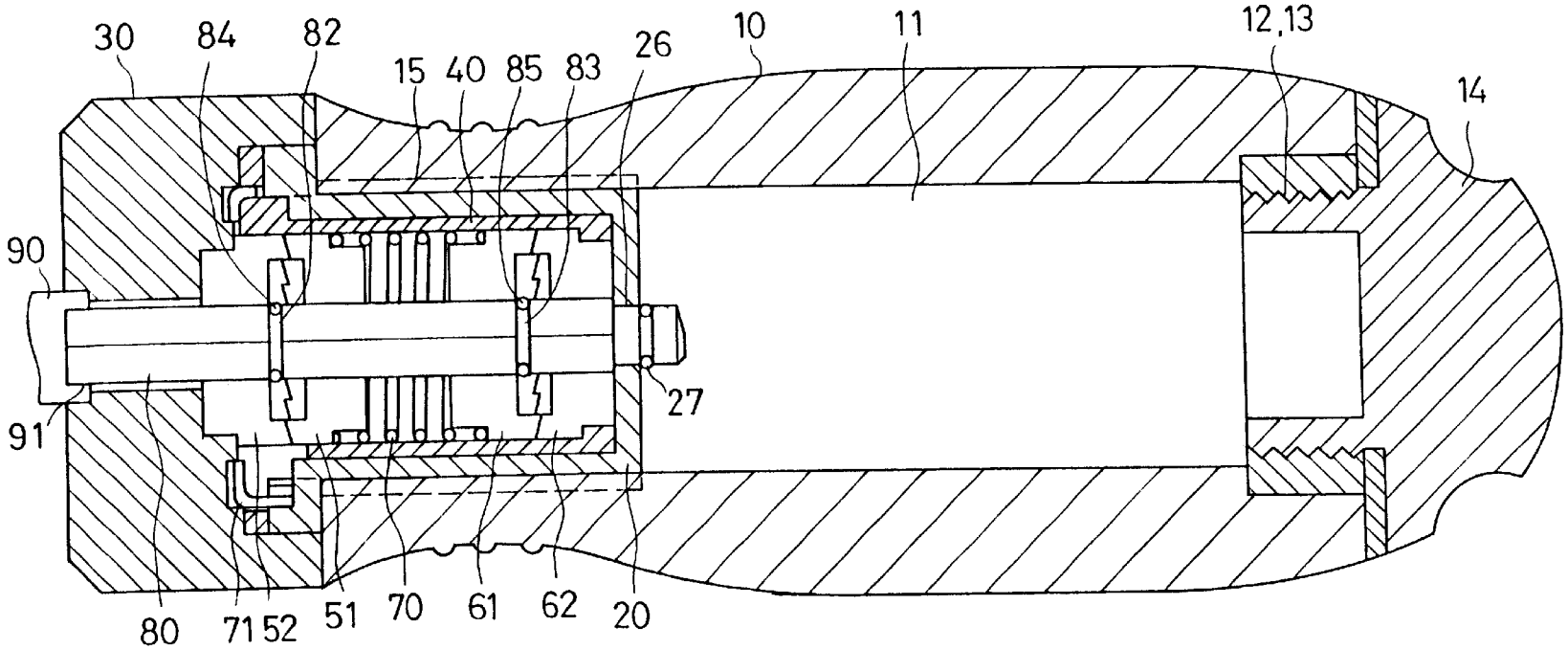
FIG. 3 is a cross sectional view of the ratchet screw driver.

Referring to the drawings, and initially to FIGS. 1 to 3, a ratchet screw driver in accordance with the present invention comprises a handle 10 including a bore 11 and including an open end 15 for receiving a housing 20. The housing 20 and the bore 11 of the handle 10 preferably include a mating non-circular cross section, such as a square cross section, or are keyed and/or force-fitted together for securing the housing 20 to the handle 10 and for allowing the housing 20 and the handle 10 to be rotated in concert with each other. The handle 10 includes an inner thread 12 formed in the rear portion thereof for threading with an outer thread 13 of a cap 14. The bore 11 of the handle 10 may be used for receiving tool bits or the other objects. The housing 20 includes a bore 21 formed therein for receiving a barrel 40, and includes one or more channels 22 formed therein and communicating with the bore 21 thereof. The housing 20 includes two or more recesses 23, 24, 25 formed in one end thereof.

The barrel 40 includes one or more openings 47 formed therein and includes one or more cavities 42 formed therein. A shaft 80 is engaged through the barrel 40 and the housing 20 and has one end 86 engaged through the rear end of the housing 20 and rotatably secured to the housing 20 with a clamping ring 27. Two ratchet gears 52, 62 each includes a non-circular hole 521, 621 formed therein and engaged with the shaft 80 having the corresponding non-circular cross section, such as a hexagonal cross section, such that the ratchet gears 52, 62 are rotated in concert with the driving stem 90. Two further ratchet gears 51, 61 each includes a hole 511, 611 rotatably receiving the shaft 80 and each includes one or more projections 512, 612 extended through the openings 47 of the barrel 40 and slidably engaged in the channels 22 of the housing 20 which may guide the gears 51, 61 to slide in the housing 20 and may prevent the gears 51, 61 from rotating relative to the housing 20. The projections 512, 612 each preferably includes a tapered surface 513, 613 formed therein. A spring 70 is engaged between the ratchet gears 51, 61 to bias the gears 51, 61 to engage with the other gears 52, 62 respectively.

Figure 4:
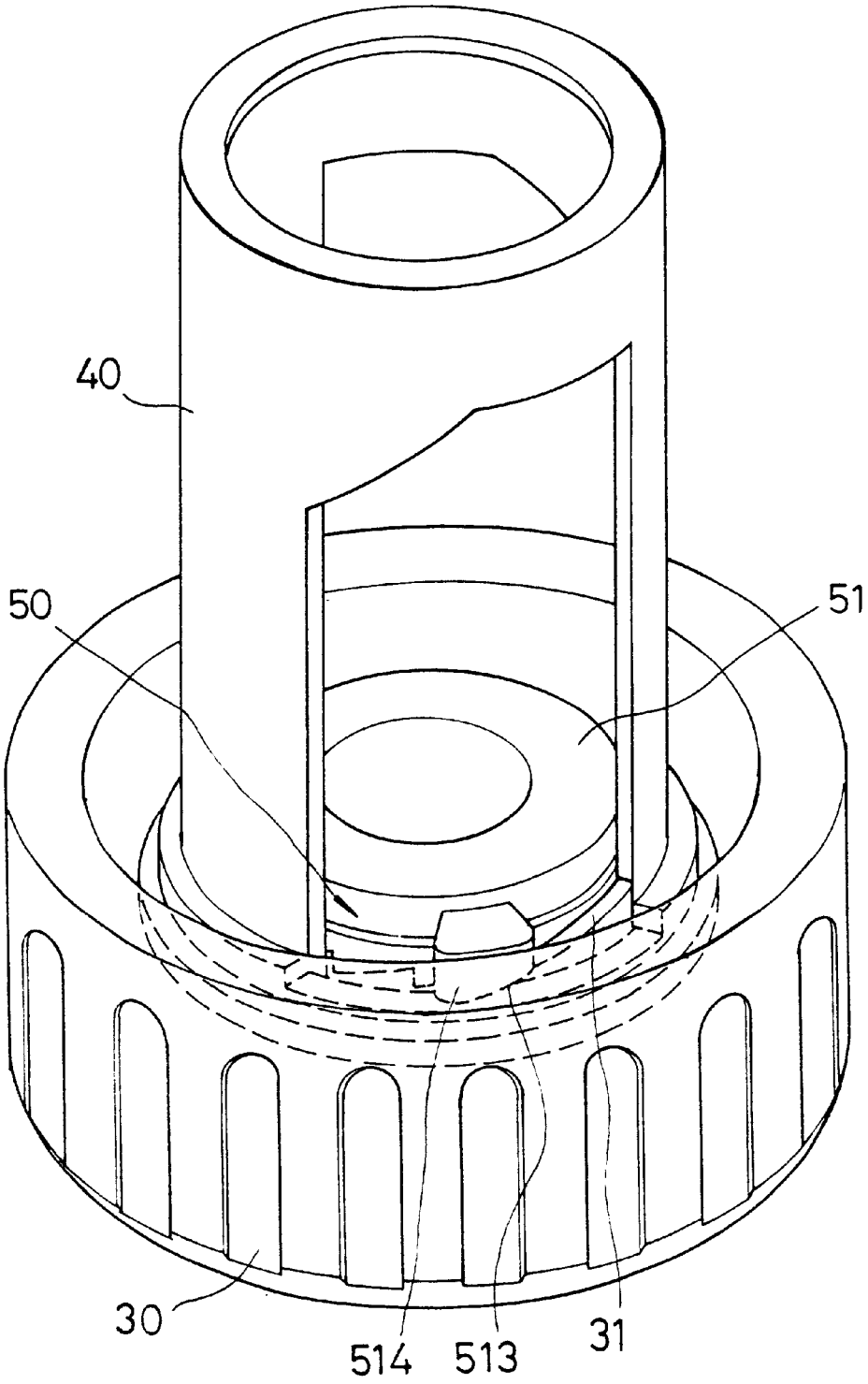
FIG. 4 is a rear perspective view of a ferrule and a casing.
Figure 5:
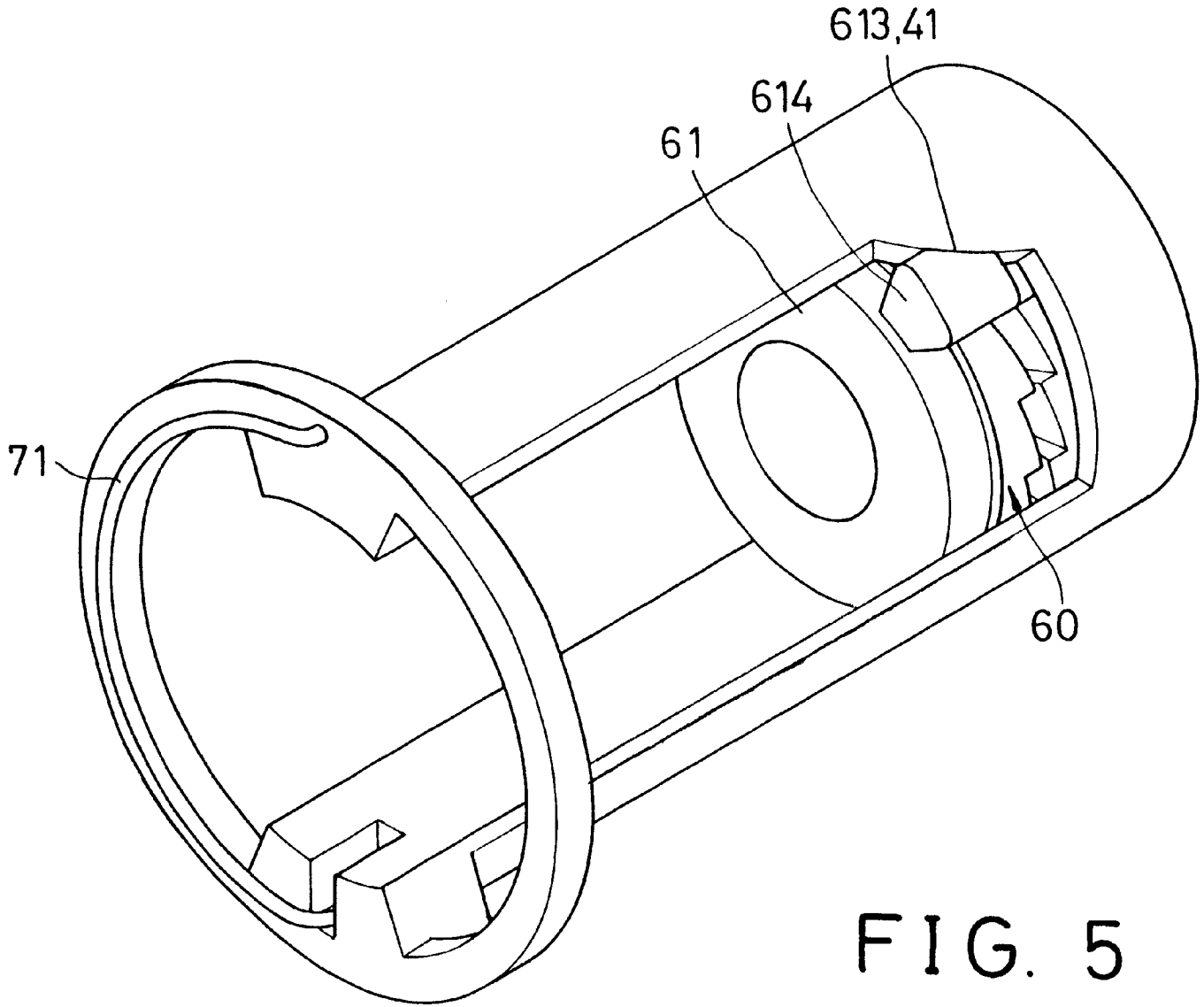
FIG. 5 is a front perspective view of the casing.
Figure 6:
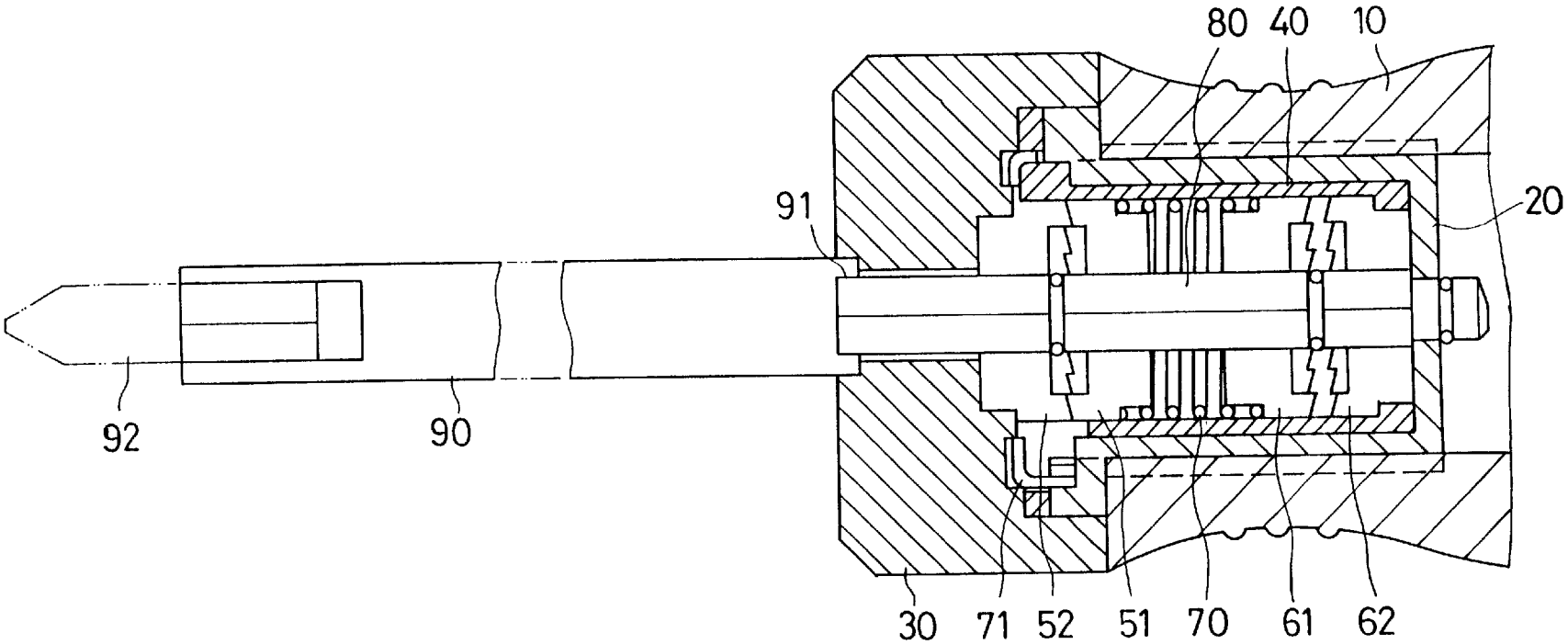
FIG. 6 is a partial cross sectional view illustrating the operation of the ratchet screw driver.

A control ferrule 30 is rotatably engaged on the shaft 80 and includes one or more inclined actuating surfaces 31 extended from a respective extension 33 and extended through one or more cavities 42 of the barrel 40 to engage with the tapered surfaces 513 of the projections 512 (FIG. 4) for disengaging the gear 51 from the gear 52 when the ferrule 30 is rotated relative to the housing 20. The extensions 33 of the ferrule 30 are preferably snugly engaged through the cavities 42 of the barrel 40 such that the barrel 40 may be rotated by the ferrule 30. The barrel 40 includes one or more inclined actuating surfaces 41 (FIGS. 1, 2, 5) for engaging with the tapered surfaces 613 of the projections 612 to disengage the gear 61 from the gear 62 when the barrel 40 is rotated relative to the housing 20 by the ferrule 30. A spring 71 has one end engaged into a hole 43 of the barrel 40 and has the other end slidably engaged in a slit 44 of the barrel 40 and engaged with either of three recesses 23, 24, 25 of the housing 20 for positioning the barrel 40 to the housing 20 at either of three angular positions. A driving stem 90 has one end 91 secured to the shaft 80 by such as a force-fitted engagement, and engaged with an annular shoulder 34 of the ferrule 30 for securing the ferrule 30 to the handle 10, and includes an engaging hole formed in the other end for receiving the tool bit 92. Two rings 84 are secured on the shaft 80 and engaged with the gears 51, 61 for limiting the relative movement between the gears 61, 62; and 51, 52 (FIGS. 3, 6).

When either of the gears 51, 61 is disengaged from the respective gears 52, 62 by the ferrule 30 or the barrel 40, the shaft 80 and thus the driving stem 90 may be driven by the handle 10 in one driving direction via the housing 20 and the barrel 40 and the pair of gears 51, 52 or 61, 62. When both the gears 51, 61 are biased to engage with the respective gears 52, 62, the driving stem 90 may be driven by the handle 10 in both of the driving directions.

It is to be noted that the barrel 40 may be directly received in the handle 10 without the housing 20 and the recesses 23–25 and the channels 22 may be directly formed in the handle 10 instead of being formed in the housing 20. The gears 51, 61 may be formed as an integral ratchet gear having ratchet teeth formed on both sides or ends thereof, and two springs may bias the ratchet gears 52, 62 to engage with the gears 51, 61.

Accordingly, the ratchet screw driver in accordance with the present invention includes one or more pairs of ratchet gears rotatably and slidably received in a housing and may be operated by an outer control ferrule.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver comprising:

a handle including a bore formed therein and including a front Portion and including a rear portion, a shaft rotatable received in said handle, a first and a second ratchet gears slidably engaged on said shaft and rotated in concert with said shaft, a third and a fourth ratchet gears rotatable and slidably engaged on said shaft and slidably engaged in said housing and rotated in concert with said housing, means for biasing said third and said fourth ratchet gears to engage with said first and said second ratchet gears respectively, means for selectively disengaging said third and said fourth ratchet gears from said first and said second ratchet gears respectively to control a driving direction of said shaft, a housing secured in said handle and including at least one channel formed therein, a barrel rotatably engaged on said shaft and rotatably received in said housing, and said third and said fourth ratchet gears each including a projection extended through said barrel and slidably engaged in said at least one channel of said housing for allowing said third and said fourth ratchet gears to be slided in and rotated in concert with said housing.

2. The ratchet screw driver according to claim 1, wherein said selectively disengaging means includes a ferrule secured to said barrel and having at least one extension extended therefrom and engaged with said projection of said third ratchet gear for disengaging said third ratchet gear from said first ratchet gear, and said selectively disengaging means includes at least one actuating surface provided in said barrel for engaging with said projection of said fourth ratchet gear and for disengaging said fourth ratchet gear from said second ratchet gear.

3. The ratchet screw driver according to claim 1 further comprising means for securing said barrel to said housing at a selected angular position.

4. The ratchet screw driver according to claim 3, wherein said housing includes three recesses formed therein, said barrel includes a slit formed therein, said securing means includes a spring having a first end secured to said barrel and having a second end slidably engaged in said slit of said barrel, said second end of said spring is selectively engaged in either of said recesses of said housing for securing said barrel to said housing at the selected angular position.

5. The ratchet screw driver according to claim 1 further comprising means for limiting a relative movement between said first and said third ratchet gears and between said second and said fourth ratchet gears.

6. The ratchet screw driver according to claim 5, wherein said limiting means includes two rings secured on said shaft and disposed between said first and said third ratchet gears and between said second and said fourth ratchet gears for limiting the relative movement between said first and said third ratchet gears and between said second and said fourth ratchet gears.

* * * * *